US009061749B2

(12) United States Patent
Leerdam et al.

(10) Patent No.: US 9,061,749 B2
(45) Date of Patent: Jun. 23, 2015

(54) METHOD FOR DRY-DOCKING A FLOATING UNIT

(71) Applicant: DOCKWISE SHIPPING B.V., Breda, NJ (US)

(72) Inventors: Hans Christiaan Leerdam, Lage Kaart (BE); Leendert Poldervaart, Monaco (MC)

(73) Assignee: DOCKWISE SHIPPING B.V., Breda (NL)

( * ) Notice: Subject to any disclaimer, the term of this patent is extended or adjusted under 35 U.S.C. 154(b) by 0 days.

(21) Appl. No.: 14/237,191

(22) PCT Filed: Apr. 24, 2013

(86) PCT No.: PCT/IB2013/001109

§ 371 (c)(1),
(2) Date: Feb. 5, 2014

(87) PCT Pub. No.: WO2013/160768

PCT Pub. Date: Oct. 31, 2013

(65) Prior Publication Data

US 2014/0238287 A1 Aug. 28, 2014

Related U.S. Application Data

(60) Provisional application No. 61/639,915, filed on Apr. 28, 2012.

(51) Int. Cl.
*B63C 7/00* (2006.01)
*B63C 1/12* (2006.01)
(Continued)

(52) U.S. Cl.
CPC . *B63C 1/12* (2013.01); *B63B 15/00* (2013.01); *B63B 35/42* (2013.01); *B63C 1/04* (2013.01); *B63B 9/00* (2013.01); *B63B 2009/008* (2013.01)

(58) Field of Classification Search
CPC ..... B63C 1/00; B63C 1/02; B63C 1/04; B63C 1/12; B63B 9/00; B63B 15/00; B63B 35/00; B63B 35/03; B63B 35/04; B63B 35/40; B63B 35/42; B63B 2009/00; B63B 2009/008
USPC ..... 114/44, 45, 50, 51
See application file for complete search history.

(56) References Cited

U.S. PATENT DOCUMENTS

| | | | | |
|---|---|---|---|---|
| 3,670,682 | A * | 6/1972 | Leavitt et al. | 114/45 |
| 5,285,743 | A * | 2/1994 | Connolly | 114/45 |
| 2004/0060497 | A1 * | 4/2004 | Smith et al. | 114/74 R |

FOREIGN PATENT DOCUMENTS

| | | |
|---|---|---|
| NL | 2005054 | 1/2012 |
| WO | 0164507 | 9/2001 |
| WO | 03086852 | 10/2003 |

OTHER PUBLICATIONS

WIPO, International Application Published Under the Patent Cooperation Treaty (PCT), International Publication No. WO 2013/160768 A1; International Publication Date Oct. 31, 2013, 28 pages. From the International Searching Authority, PCT International Search Report (PCT Article 18 and Rules 43 and 44) mailed on Sep. 25, 2013; 4 pages.

(Continued)

*Primary Examiner* — Daniel V Venne
(74) *Attorney, Agent, or Firm* — Strasburger & Price, LLP

(57) ABSTRACT

A system and method of performing a dry-dock operation on a floating vessel, while the floating vessel may maintain operations. The dry-docking may be performed by another vessel, such as a semi-submersible transport vessel. The method may include: submerging the semi-submersible transport vessel, adjusting the positions of the vessels until the vessel is over the deck of the semi-submersible transport vessel, securing the vessel on the deck of the semi-submersible transport vessel, raising both vessels, performing the dry-dock operation, lowering the vessel back into the water, and unsecuring vessel from the semi-submersible transport vessel. The system may include suitable elements to perform the method.

8 Claims, 7 Drawing Sheets

(51) Int. Cl.

| | |
|---|---|
| ***B63C 1/04*** | (2006.01) |
| ***B63B 9/00*** | (2006.01) |
| *B63C 1/02* | (2006.01) |
| *B63B 15/00* | (2006.01) |
| *B63B 35/42* | (2006.01) |

(56) References Cited

OTHER PUBLICATIONS

From the International Searching Authority, PCT Written Opinion of the International Searching Authority (PCT Rule 43bis.1) mailed on Sep. 25, 2013; 6 pages.

* cited by examiner

METHOD FOR DRY-DOCKING A FLOATING UNIT

CROSS REFERENCE TO RELATED APPLICATIONS

This application claims the benefit of Provisional U.S. Patent Application No. 61/639,915 filed Apr. 28, 2012, which application is hereby incorporated by reference in its entirety.

BACKGROUND OF THE DISCLOSURE

1. Field of the Disclosure

The present disclosure relates to a method for performing offshore dry-docking services on a water-borne vessel, and, in particular, a Floating Production Storage and Offloading (FPSO) vessel while keeping mooring and riser systems connected.

2. Description of the Related Art

Water-borne monohull or multihull vessels require mandatory and incidental maintenance, repair, and inspection over their operational lifetimes. Some of these operations may require access to the part of the vessel that is normally submerged, such as the outer hull below the water line, propellers, sonar systems, seawater intakes, riser porches, etc. Some of these operations may be performed by divers; however, the time and expense of using divers may be high. Other operations are not performable unless the relevant sections of the vessel are removed from the water.

Numerous water-borne vessels are involved in time-sensitive and/or costly business endeavors, such as offshore refining/production/storage/drilling of petroleum. For example, Floating Production, Storage, and Offloading (FPSO) vessels are designed to receive hydrocarbons produced from nearby platforms or subsea template, process them, and store the hydrocarbons until they can be offloaded onto a tanker or transported through a pipeline. Typically, an FPSO is coupled to several wellheads on the bottom of the ocean.

The onshore dry-docking of a vessel in a port or harbor results in a loss of operating time or the cost of acquiring the services of a replacement vessel for the period of maintenance/repair and the time of travel to and from the dry-dock facility. For example, should the FPSO require repair or maintenance, the FPSO must be taken off line (closing the wellheads and removing the coupling lines) (i.e., the FPSO is in a non-operational state), and the FPSO is then directed to an onshore dry-dock. This prior method could cost operators millions of dollars in lost revenue as a result of a non-operational FPSO or having to obtain another FPSO to continue the production, processing and storage of hydrocarbons from the underwater formations. What is needed is a method of dry-docking a vessel offshore that reduces the time that the vessel is out of service. What is also needed is a method of dry-docking a vessel offshore without relocated the vessel or its cargo.

BRIEF SUMMARY OF THE DISCLOSURE

In aspects, the present disclosure is related to a system and method for performing offshore dry-docking services of a water-borne vessel, and, in particular, a floating unit, such as a Floating Production Storage and Offloading (FPSO) vessel, on an ocean site while keeping mooring and riser systems connected to the floating unit.

One embodiment according to the present disclosure includes a method for dry-docking a first vessel connected to a pipeline using a second vessel, the method comprising:

raising a normally submerged section of the first vessel above a water level using the second vessel, while the first vessel is connected to the pipeline wherein the first vessel is disposed at least partially on a deck of the second vessel. The first vessel may be moored using one connected to one or more anchor lines. One or more of the anchor lines may be slack. The method may include performing vessel operations while the first vessel is in a raised position or being raised. The vessel operations may include specialized vessel operations. The first vessel may be a Floating Production Storage and Offloading (FPSO) vessel and the second vessel is a semi-submersible transport vessel. The FPSO vessel operations may include one or more of: hydrocarbon extraction from a wellhead to the FPSO vessel and hydrocarbon processing. The method may include performing a dry-dock operation on the normally submerged section while the first vessel continues performing the vessel operations. The dry dock operation may include one or more of: i) repairing the normally submerged section; ii) performing maintenance on the normally submerged section; and iii) inspecting the normally submerged section. The method may include submerging the deck of the second vessel. The submerging may include filling at least one ballast tank. The method may include moving the deck of the second vessel into a position below the first vessel and/or moving the first vessel to a position above the deck of the second vessel. The deck of the second vessel may be substantially flat. The first vessel may rest fully on the deck or the first vessel may overhang a front of the deck and/or overhang an aft of the deck. The step of raising the normally submerged section of the first vessel step may include at least partially emptying at least one ballast tank. The normally submerged section is a portion of the first vessel may be selected for at least one of: i) repair, ii) maintenance, and iii) inspection. The second vessel may be self-propelled.

Another embodiment according to the present disclosure may include a method for dry-docking a first vessel using a second vessel, the method comprising: performing a dry-dock operation while the first vessel maintains vessel operations, wherein the dry-dock operation involves a normally submerged section of the first vessel that has been raised above a water level using a deck of the second vessel. The dry-dock operation may include one or more of: i) repairing the normally submerged section; ii) performing maintenance on the normally submerged section; and iii) inspecting the normally submerged section. The method may also include: submerging the deck of the second vessel; moving the first vessel and the second vessel relative to one another; and raising the normally submerged section of the vessel above the water level using the second vessel. The raising of the submerged section of the first vessel may include at least partially emptying at least one ballast tank. The moving of the first vessel and the second vessel relative to one another step comprises may include at least one of: moving the deck of the second vessel into a position below the first vessel and moving the vessel to a position above the deck of the second vessel. The deck of the second vessel may be substantially flat. The first vessel may be disposed fully or partially overhanging the deck of the second vessel. The normally submerged section of the first vessel may be selected for at least one of: i) repair, ii) maintenance, and iii) inspection. The vessel operations may include specialized vessel operations. The vessel operations may include one or more of: hydrocarbon extraction from a wellhead to the first vessel and hydrocarbon processing. The first vessel may be a floating production, storage, and offloading vessel (FPSO) and the second vessel is a semi-submersible transport vessel. The first vessel may be connected to a pipeline and/or moored with an anchor line. The anchor line may be slack. The second vessel may be self-propelled.

Another embodiment according to the present disclosure includes a method for dry-docking a vessel using a semi-submersible transport vessel, the method comprising: submerging a deck of the semi-submersible transport vessel; moving the vessel and the semi-submersible transport vessel relative to one another such that the deck of the semi-submersible transport vessel is positioned below the vessel; raising a normally submerged section of the vessel above a water level; and maintaining vessel operations while the normally submerged section of the vessel is above the water level. The method may include performing a dry-dock operation involving the normally submerged section. The dry-dock operation may include one or more of: i) repairing the normally submerged section; ii) performing maintenance on the normally submerged section; and iii) inspecting the normally submerged section. The deck may be substantially flat. The vessel may be positioned to be fully on the deck or overhanging one or more sides of the deck. The submerging step may include filling at least one ballast tank. The raising the normally submerged section may include at least partially emptying at least one ballast tank. The normally submerged section may be a portion of the first vessel selected for one or more of: i) repair, ii) maintenance, and iii) inspection. The vessel operations may include one or more of: hydrocarbon extraction from a wellhead to the vessel and hydrocarbon processing. The vessel may be a floating production, storage, and offloading vessel (FPSO). The vessel may be connected to a pipeline and/or moored with an anchor line. The anchor line may be slack. The semi-submersible transport vessel is self-propelled. The vessel operation may be a specialized vessel operation.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

Figure 1:
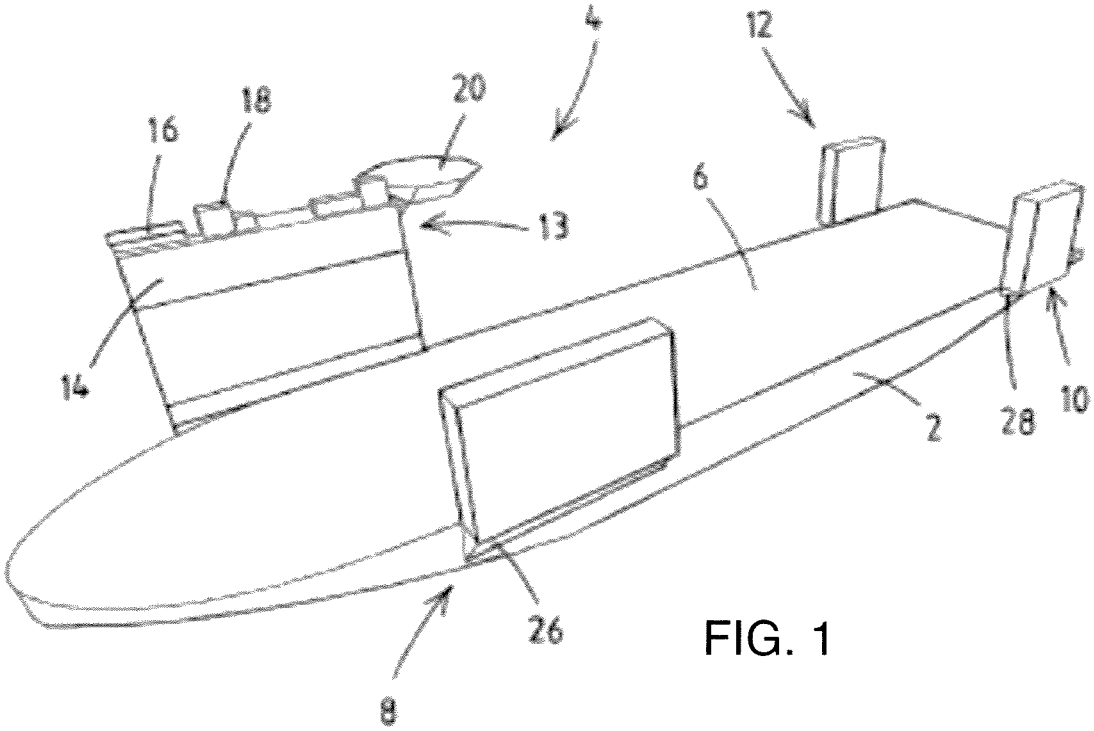
FIG. 1 is a perspective view of a submersible semi-submersible transport vessel according to one embodiment of the present disclosure.

Generally, the present disclosure relates to a method for performing offshore dry-docking services of a water-borne vessel, and, in particular, a Floating Production Storage and Offloading (FPSO) vessel on an offshore site while keeping mooring and riser systems connected and maintaining operation and production, if possible. The present disclosure is susceptible to embodiments of different forms. They are shown in the drawings, and herein will be described in detail, specific embodiments of the present disclosure with the understanding that the present disclosure is to be considered an exemplification of the principles of the present disclosure and is not intended to limit the present disclosure to that illustrated and described herein.

FIG. 1 shows an exemplary first vessel, such as a semi-submersible transport vessel 1 for use with at least one embodiment according to the present disclosure. One exemplary semi-submersible transport vessel is the Vanguard heavy transport vessel, owned and operated by Dockwise, Ltd., the applicant for the present application. The semi-submersible transport vessel 1 is shown from its forward port side. The semi-submersible transport vessel 1 may comprise a hull 2 and a fixed superstructure 4. In some embodiments, the semi-submersible transport vessel 1 may be self-propelled, and the hull 2 may comprise a propulsion system and/or dynamic positioning system (not shown) configured to propel and/or position the vessel. The propulsion system may include a shaft extending through the hull from the engine to the propeller and/or rotatably mounted propellers, each with an individual drive, such as commonly used in a dynamic positioning system. In some embodiments, there may be another suitable propulsion system known to a person of skill in the art. In some embodiments, semi-submersible transport vessel 1 may be positioned or moved by another vessel.

The hull 2 may also comprise ballast tanks (not shown) configured to receive/release water to provide different amounts of buoyancy. The topside of hull 2 may include a deck 6. The deck 6 may be substantially flat. In some embodiments, the deck 6 may be completely flat. In some embodiments, the deck 6 may be configured based on the hull shape of the vessel that is to be received by the semi-submersible transport vessel 1.

The semi-submersible transport vessel 1 may also include one or more stabilization casings, configured to stabilize the vessel 1 during the submerged phase and/or provide work area for mooring winches to position the vessel or cargo above the semi-submersible transport vessel 1. The semi-submersible transport vessel 1 shown has three stabilization casings—one front port stabilization casing 8, one aft port stabilization casing 10, and one aft starboard stabilization casing 12. Herein, the semi-submersible transport vessel 1 has a length of 275 meters, a breadth of 70 meters, and a depth of 15.5 meters. These dimensions are illustrative and exemplary only, as the semi-submersible transport vessel may be constructed with dimensions suitable to the cargo or vessel to be carried on the deck 6 as would be understood by a person of ordinary skill in the art.

Figure 2:
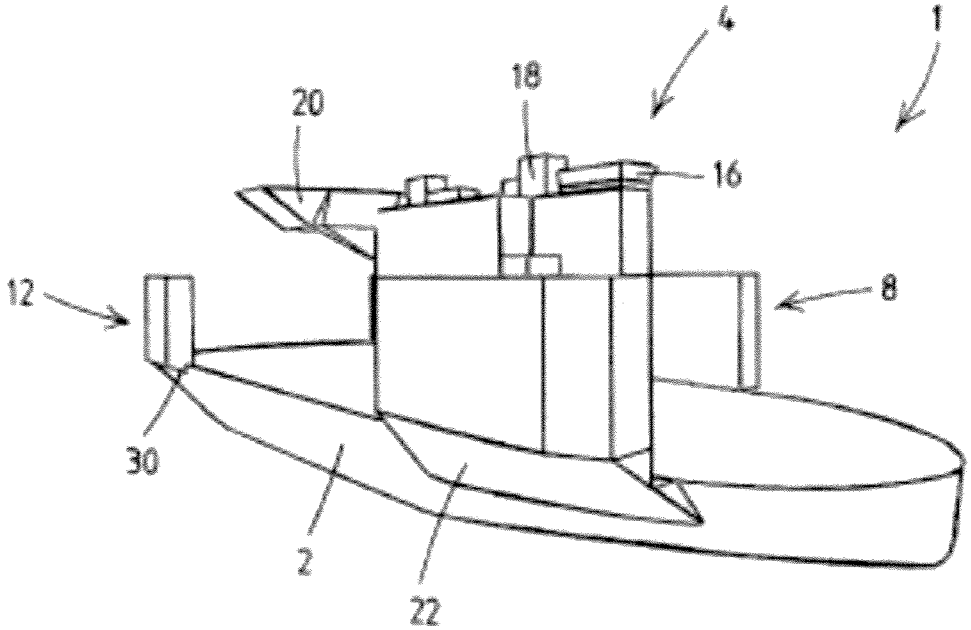
FIG. 2 is a perspective view of the vessel of FIG. 1 in a front view from the starboard side according to one embodiment of the present disclosure.

The fixed superstructure 4 may include a bridge 13. The bridge 13 may include an accommodation layer 14 with accommodations for a crew, a control bridge 16, duct outlets 18 and a helicopter platform 20. Here, the fixed superstructure 4 is fixed permanently to the hull 2 in a front starboard position located on a foundation 22 (FIG. 2), which is attached to the starboard side of the hull 2. In this manner, the fixed superstructure 4 may be completely or substantially beside the deck 6. Likewise, the front port stabilization casing 8 rests on a foundation 26; the aft port stabilization casing 10 rests on a foundation 28; and the starboard aft stabilization casing 12 rests on a foundation 30 (FIG. 2). The location of the fixed superstructure 4 in the front starboard position is exemplary and illustrative only, as the fixed superstructure 4 may be disposed in any other suitable position that reduces or eliminates the footprint of the fixed superstructure 4 that overlaps with the deck 6. The stabilization casings 8, 10, 12 may be rearranged in a different position inwards/outwards and in longitudinal directions. In some embodiments, the foundations 22, 26, 28, 30 may also be repositioned.

FIG. 2 shows the semi-submersible transport vessel 1 from the forward starboard side. Since the footprint of the fixed superstructure 4 on the deck 6 is reduced by the use of the foundation 22, less than 25 percent of the horizontal cross-section (breadth) of the deck 6 is occupied by the fixed superstructure 4. In some embodiments the fixed superstructure 4 may occupy 10 percent or less of the breadth of the deck 6.

Figure 3:
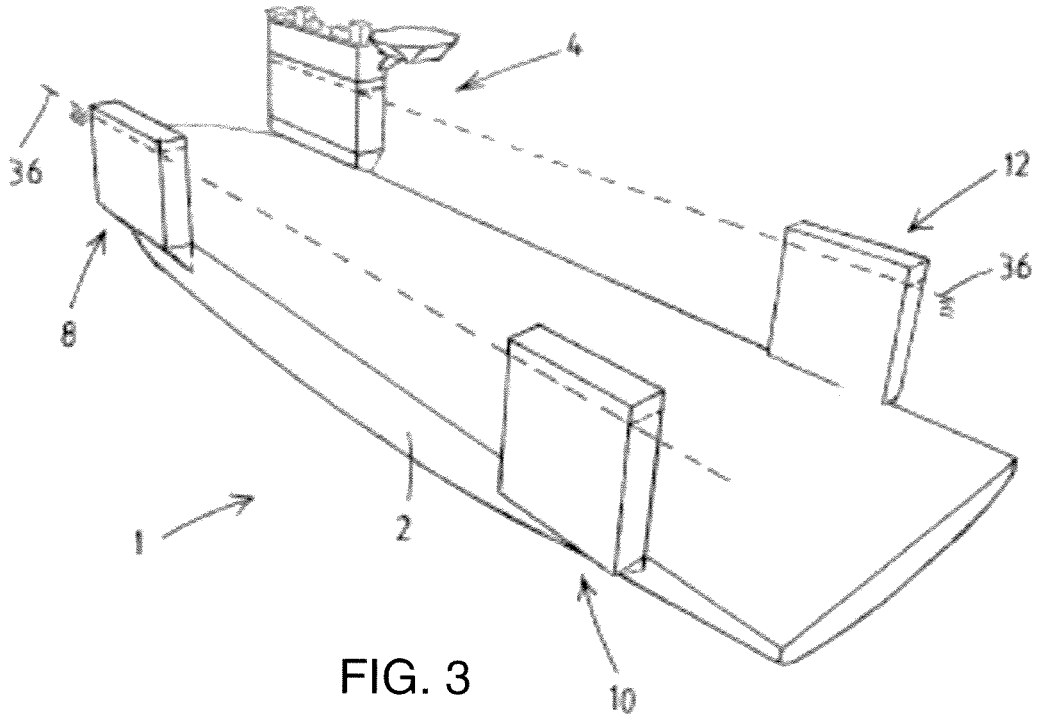
FIG. 3 is a perspective view of the vessel of FIG. 1 in a back top view from the port side according to one embodiment of the present disclosure.

FIG. 3 shows the semi-submersible transport vessel 1 from the aft port side. The semi-submersible transport vessel 1 may fill one or more ballast tanks (not shown) to decrease buoyancy and increase the draft of the semi-submersible transport vessel 1, such the semi-submersible transport vessel 1 at least partially submerges. When the semi-submersible transport vessel 1 is partly submerged, the water level 36 may be above the deck 6. During loading/unloading of the deck cargo by float operation, the ballast tanks are filled to such an extent that the deck 6 is fully below the water level 36, while the fixed superstructure 4 and the casings 8, 10, 12 still intersect the water level 36. Then the deck cargo may be floated on/off.

Figure 4:
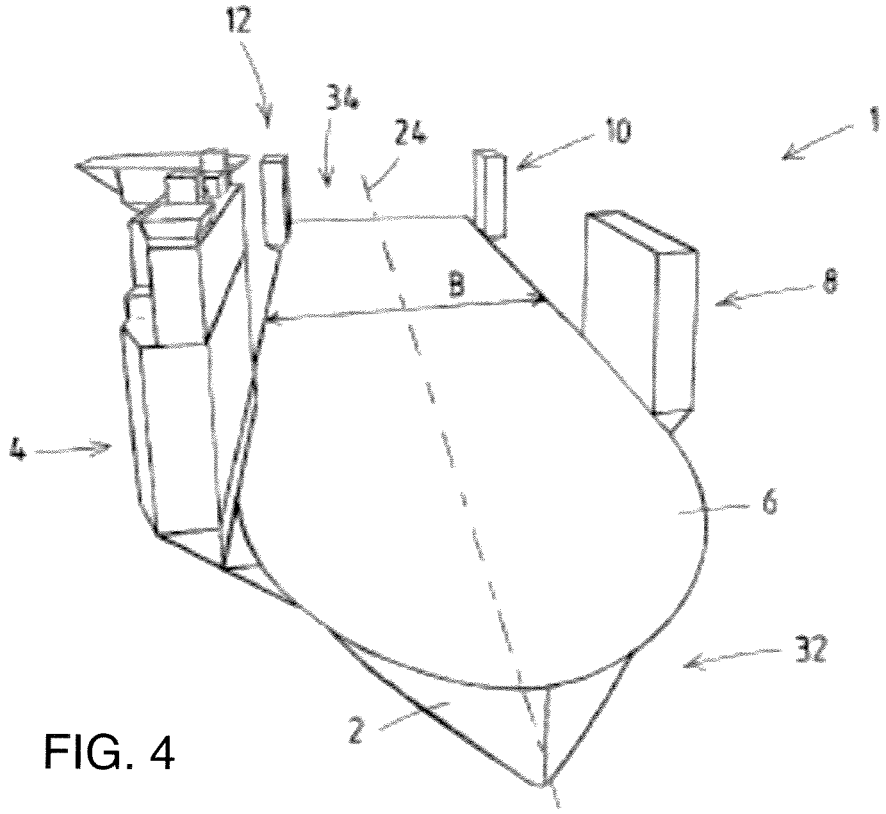
FIG. 4 is a perspective view of the vessel of FIG. 1 in a front top view according to one embodiment of the present disclosure.

FIG. 4 shows the semi-submersible transport vessel 1 from the forward side. The fixed superstructure 4 is shown completely at one side of the deck 6. The deck 6 is divided by a longitudinal center line 24. The breadth of the deck 6 is shown as B. The fixed superstructure 4 may have a breadth of about 25 percent or less of the breadth B. As shown, the open deck breadth that is free of the fixed superstructure 4 is more than 90 percent of the maximum breadth B. Thus, in this embodiment, the deck 6 extends freely over more than 90 percent of the maximum breadth B from a front 32 of the deck 6 to an end 34 of the deck 6. In this configuration, the semi-submersible transport vessel 1 may carry a cargo where the cargo may be as long as, or even longer, than the length of the deck 6 of the semi-submersible transport vessel 1 itself. In some embodiments, the semi-submersible transport vessel 1 may receive cargo that extends beyond one or both of the front 32 and the aft 34 of the semi-submersible transport vessel 1. If the cargo is positioned between the fixed superstructure 4 and the casings 8, 10, 12, then the cargo may have a breadth which is almost equal to the maximum breadth B of the semi-submersible transport vessel 1. In some embodiments, the cargo may be another vessel. In some embodiments, the cargo may be a specialized vessel, such as a Floating Production, Storage, and Offloading (FPSO) vessel.

In one embodiment, the cargo may also extend laterally off the side of the deck 6 on a side opposite the fixed superstructure 4. To enable this, at least the front port stabilization casing 8 may be removed or relocated. This reconfiguration enables the semi-submersible transport vessel 1 to carry a cargo that is both longer and wider than the deck 6. The cargo may also be wider than the semi-submersible transport vessel 1 by sticking out over one or more of the sides of the deck 6 between the casings 8, 10, 12.

Several alternative embodiments are possible within the scope of the present disclosure. The fixed superstructure 4 may be placed at the port side, and/or the aft of the semi-submersible transport vessel 1. The semi-submersible transport vessel 1 may comprise just one or more stabilization casings 8, 10, 12. The stabilization casings 8, 10, 12 may be configured as fixed, removable, or displaceable. The stabilization casings 8, 10, 12 may be selected based on the type or dimension of the cargo, including length and breadth of the cargo relative to the dimensions of the deck 6.

In some embodiments, one or more floating stabilization elements (not shown) may be used to compensate for the removal of one or more of the stabilization casings 8, 10, 12 or to enhance stabilization generally. Floating stabilization elements may be connected via suitable lines (wires, cables, chains, etc.) to the hull 2 and/or one or more counterweights (not shown) that may be lowered on the seabed and connected through lines to the hull 2. The floating stabilization elements may be provided at the front and/or aft and at port and/or starboard of the semi-submersible transport vessel 1. The counterweights may be disposed at the front and/or aft and at port and/or starboard of the semi-submersible transport vessel 1.

If the semi-submersible transport vessel 1 includes a propulsion system, the propulsion system may be connected to ducts (not shown). These ducts may be connected to duct outlets 18, which remain above the water level 36 even during transport and while being submerged. Due to the fact that the superstructure 4 is fixed to the hull 2, the ducts may extend from the propulsion system into the fixed superstructure 4.

Figure 5:
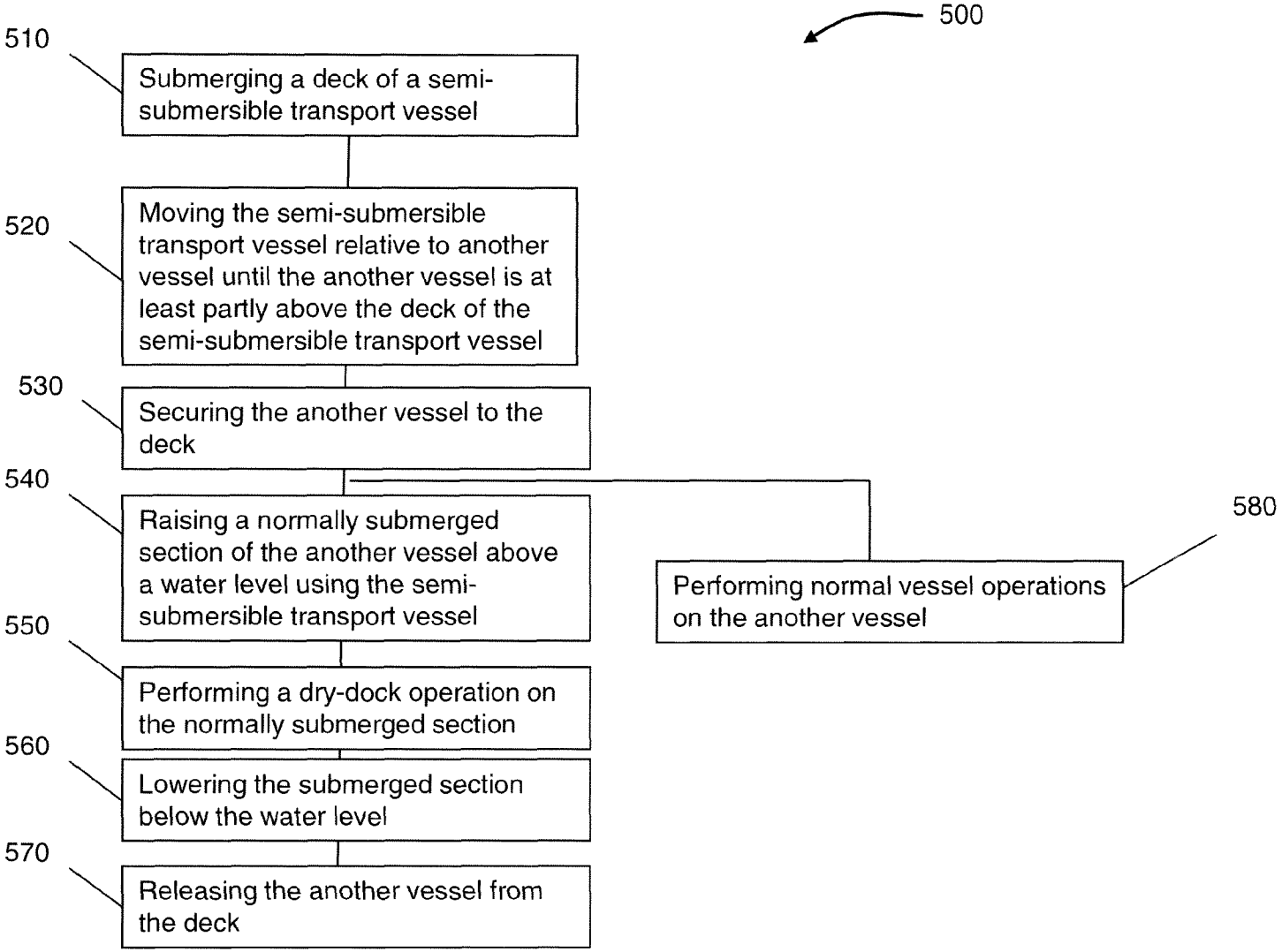
FIG. 5 is a flow chart of an exemplary method of dry-docking a vessel according to one embodiment of the present disclosure.

FIG. 5 shows an exemplary method 500 according to one embodiment of the present disclosure. In step 510, the deck 6 of the semi-submersible transport vessel 1 may be submerged. The submergence may be performed by reducing the buoyancy of the semi-submersible transport vessel 1 by receiving water into one or more ballast tanks that are part of the hull 2. The deck 6 may be submerged sufficiently so as to be positioned below the bottom of a cargo that is to be loaded on the deck 6. In some embodiments, the cargo may be a ship, such as an FPSO vessel 600 (FIG. 6). The FPSO vessel 600 may be permanently attached to anchor lines 615 and/or one or more pipelines 610 (FIG. 6). The anchor lines 615 may be used to moor the FPSO on station and to moor the combination of the semi-submersible transport vessel and cargo once loaded on deck 1. The pipelines 610 may include a hydrocarbon extraction pipeline connected to a subsea wellhead 620 (FIG. 6). In step 520, the semi-submersible transport vessel 1 may be moved relative to the FPSO vessel 600 until at least part of the FPSO vessel 600 is positioned above the deck 6. The use of an FPSO vessel as the cargo is exemplary and illustrative only, as other suitable vessels or floating structures may be used as well as would be understood by a person of ordinary skill in the art with the benefit of the present disclosure. The relative movement between the semi-submersible transport vessel 1 and the FPSO vessel 600 may be accomplished by moving either or both of the semi-submersible transport vessel 1 and the FPSO vessel 600. In step 530, the FPSO vessel 600 may be secured on the deck 6. The securing of the FPSO vessel 600 may include using friction between the vessel 1 deck and the cargo and/or include temporary attachment of the FPSO vessel 600 to one or more of: i) the deck 6 and ii) a stabilization casing 8, 10, 12.

In step 540, the deck 6 may be raised by increasing the buoyancy of the semi-submersible transport vessel 1. The buoyancy increase of the semi-submersible transport vessel 1 may include removing water from one or more ballast tanks in the hull 2. The FPSO vessel 600 may include a normally submerged section 630 (FIG. 6), which may be raised along with the FPSO vessel 600 when the semi-submersible transport vessel 1 rises relative to the water line 640 (FIG. 6). The normally submerged section 630 may be selected based on a requirement or desire to have said normally submerged section 630 repaired, maintained, and/or inspected. When in the raised position, the length of the FPSO vessel 600 may be fully on the deck 6 or may overhang the front 32 and/or the aft 34. In step 550, a dry-dock operation may be performed on the normally submerged section 630. The dry-dock operation may include, but is not limited to, one or more of: i) repairing the normally submerged section 630, ii) performing maintenance on the normally submerged section 630, and iii) inspecting the normally submerged section 630.

In step 560, the normally submerged section 630 may be lowered back below the water line 640, along with the FPSO vessel 600, by submerging the semi-submersible transport vessel 1 sufficiently so that the deck 6 is no longer contacting the bottom of the FPSO vessel 600. In step 570, the FPSO vessel 600 may be released/unsecured from the semi-submersible transport vessel 1. In some embodiments, step 570 may take place after step 550. In step 580, the FPSO vessel is performing vessel operations, which may include, but is not limited to, one or more of: extracting hydrocarbons from the wellhead 620 through the pipeline 610, and processing hydrocarbons. In some embodiments, the vessel operations may include "specialized vessel operations." Herein, the term "specialized vessel operations" is defined as activities that the vessel is specially configured for, performed while not under its own propulsion, and cannot be performed in an onshore dry-dock. Exemplary vessels with specialized vessel operations may include, but are not limited to, Floating Storage Units (FSUs), Floating Storage and Re-gasification units (FSRUs), Floating Liquefaction Units (FLNGs), Floating Power Generation units (FPGUs), semi-submersible production units, drilling units, and power generation units. During the dry-dock operation of step 550, the FPSO vessel 600 may remain operational at full or limited capacity. That is, the coupling lines 610 remain attached to the underwater wellheads 620 and hydrocarbons (such as oil or gas) may continue to be recovered onto the FPSO vessel 600 for processing and/or storage. Production and storage are not halted while the FPSO is in dry-dock on the semi-submersible transport vessel 1. Step 580 is necessarily being performed during step 550; however, step 580 may also be performed in parallel with any or all of steps 510 through 570.

In some embodiments, the semi-submersible transport vessel 1 may be self-propelled and may be equipped with a dynamic positioning system. In some embodiments, the semi-submersible transport vessel 1 may be maneuvered into position by a third vessel. In some embodiments, the deck 6 may be substantially flat. In some embodiments, the deck 6 may be contoured or dimensional to receive the cargo, including, but not limited to, a ship bottom.

Figure 6A:
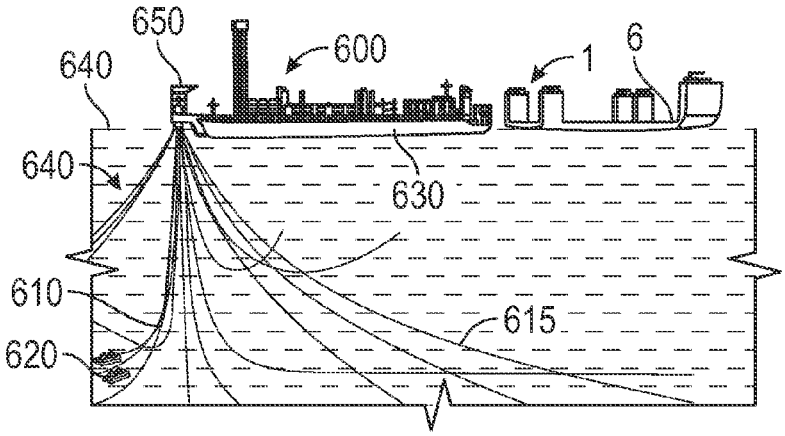
FIG. 6A is a schematic of a semi-submersible transport vessel and an FPSO with an external turret according to one embodiment of the present disclosure.
Figure 6B:
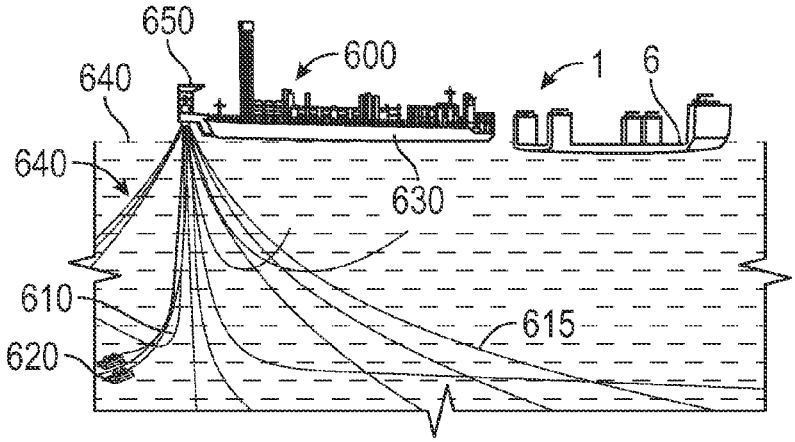
FIG. 6B is a schematic of step 510 of the method of FIG. 5.
Figure 6C:
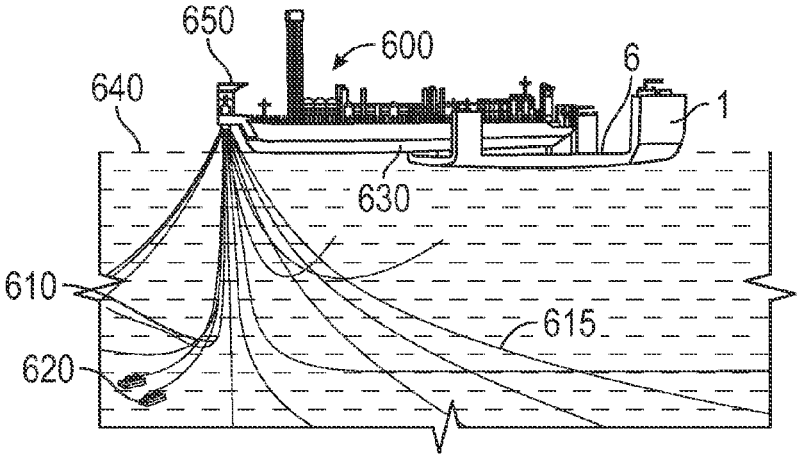
FIG. 6C is a schematic of step 520 of the method of FIG. 5.
Figure 6D:
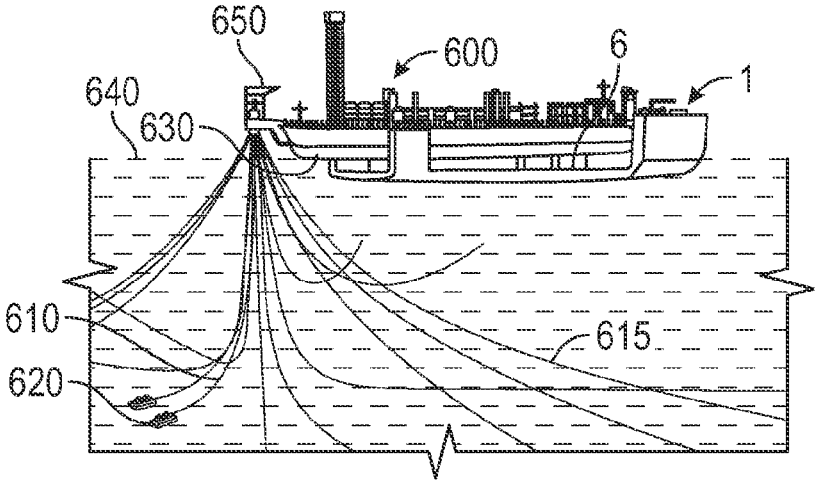
FIG. 6D is a schematic of step 530 of the method of FIG. 5.
Figure 6E:
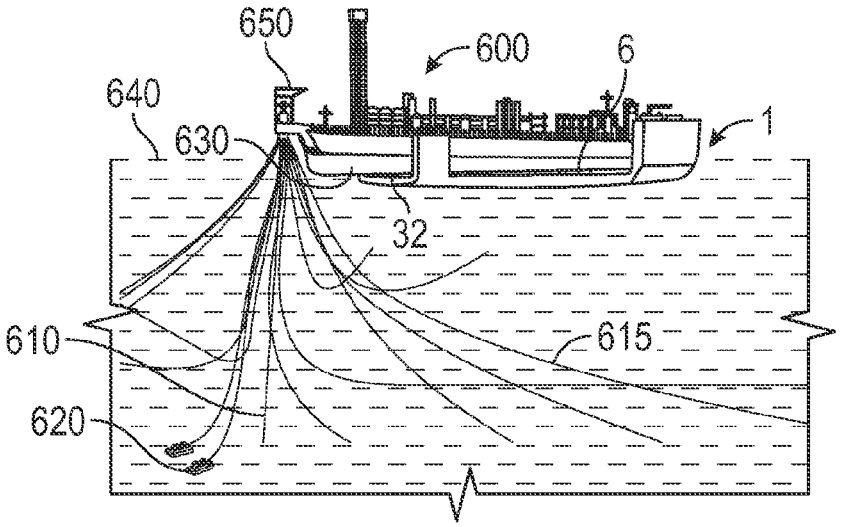
FIG. 6E is a schematic of step 540 of the method of FIG. 5.
Figure 6F:
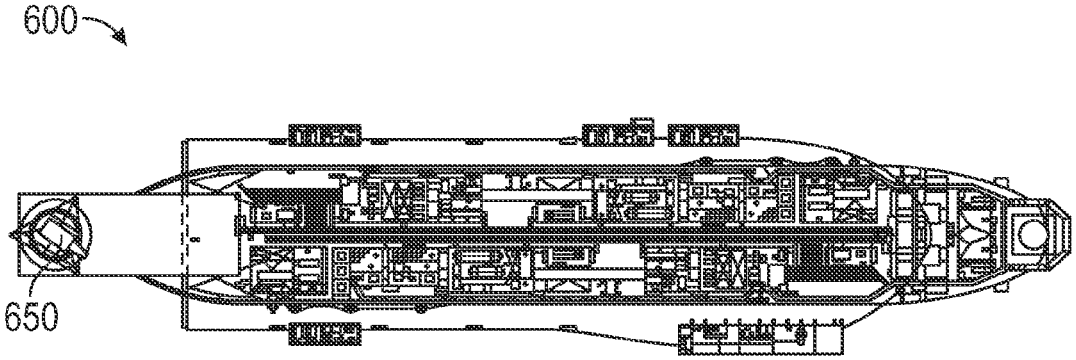
FIG. 6F is a top view of the FPSO of FIG. 6A.

FIGS. 6A, 6B, 6C, 6D, 6E, and 6F show an embodiment of the method 500 according to the present disclosure. FIG. 6A shows FPSO vessel 600 adjacent to semi-submersible transport vessel 1. FIG. 6B shows semi-submersible transport vessel 1 submerging (step 510). FIG. 6C shows the FPSO vessel 600 moving relative to the semi-submersible transport vessel 1 (step 520). FIG. 6D shows the FPSO vessel 600 in position on the deck 6 and secured (step 530). FIG. 6E shows the FPSO vessel 600 raised on the deck 6 with the normally submerged section 630 above the water level 640 (step 540), while the anchor lines 615 and/or pipelines 610 remain attached to an external mooring turret 650 of the FPSO vessel 600 and the wellheads 620. FIG. 6F is a top view of the FPSO vessel 600 with the external mooring turret 650. The external mooring turret 650 may hang off of the deck 6 even if the entire length of the bottom of the FPSO vessel 600 is resting on deck 6.

Figure 7A:
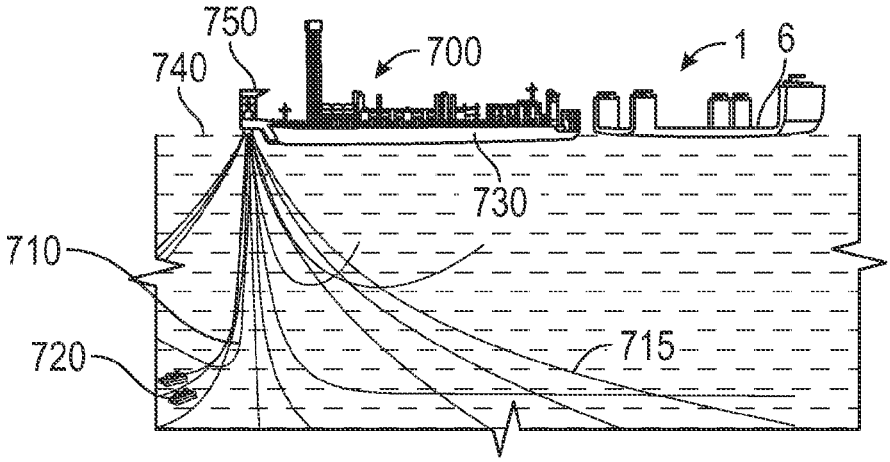
FIG. 7A is another schematic of a semi-submersible transport vessel and an FPSO with an internal turret according to one embodiment of the present disclosure.
Figure 7B:
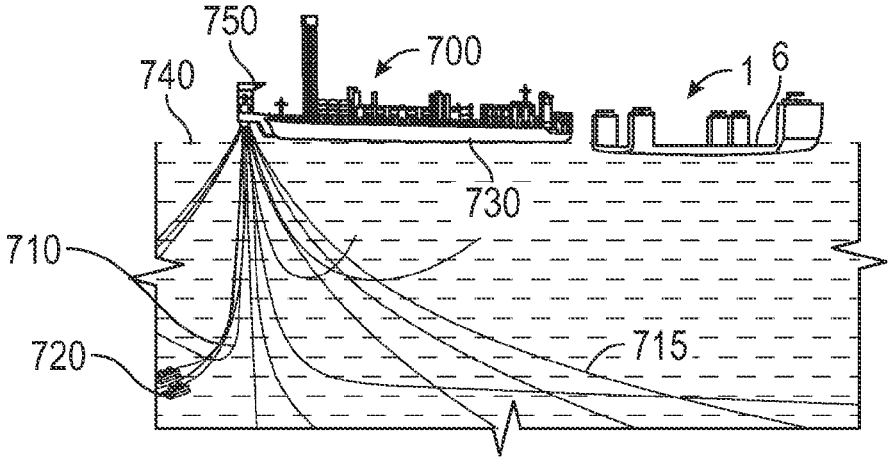
FIG. 7B is a schematic of step 510 of the method of FIG. 5.
Figure 7C:
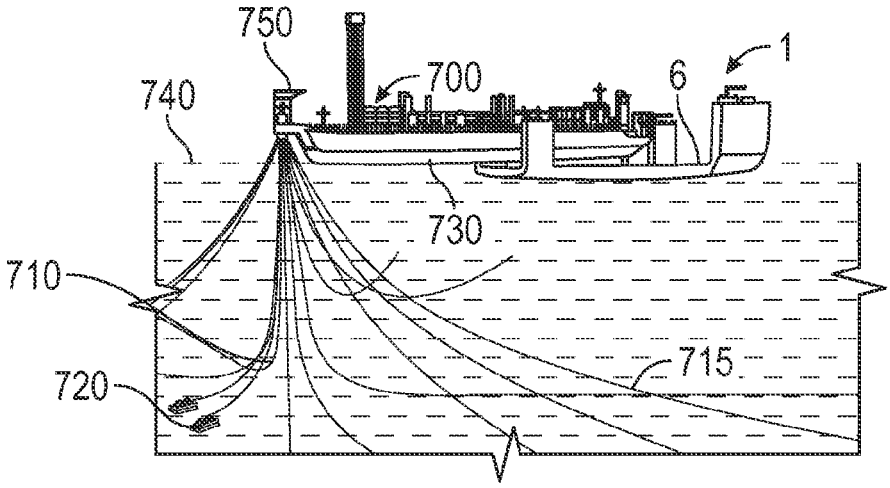
FIG. 7C is another schematic of step 520 of the method of FIG. 5.
Figure 7D:
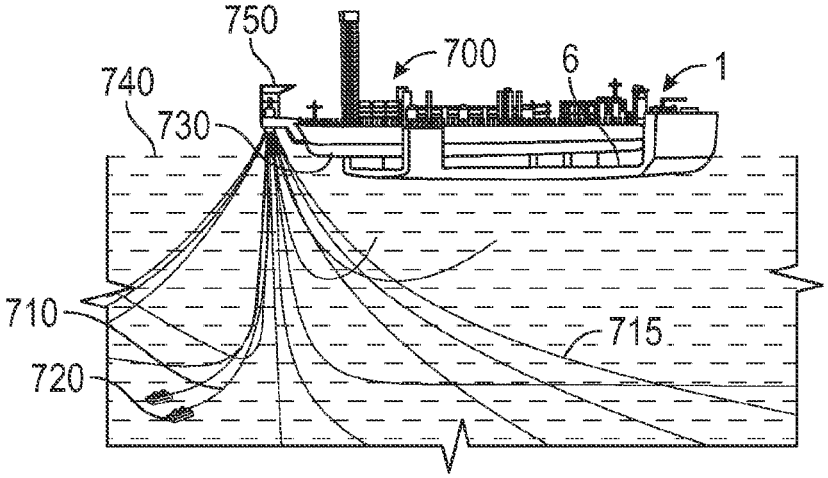
FIG. 7D is another schematic of step 530 of the method of FIG. 5.
Figure 7E:
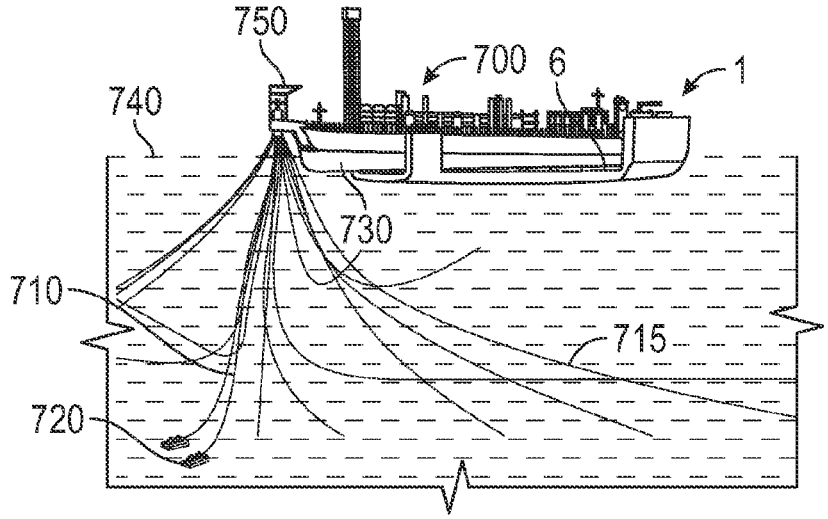
FIG. 7E is another schematic of step 540 of the method of FIG. 5.
Figure 7F:
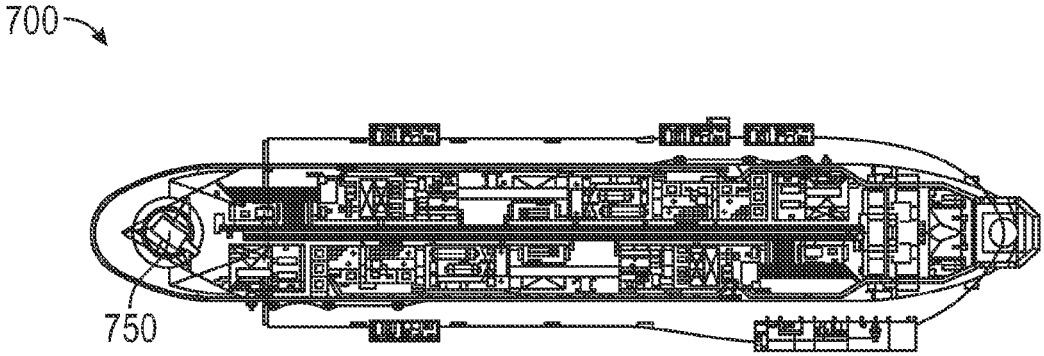
FIG. 7F is a top view of the FPSO of FIG. 7A.

FIGS. 7A, 7B, 7C, 7D, 7E, and 7F show an embodiment of the method 500 according to the present disclosure. FIG. 7A shows FPSO vessel 700 next to semi-submersible transport vessel 1. FIG. 7B shows semi-submersible transport vessel 1 submerging (step 510). FIG. 7C shows the FPSO vessel 700 moving relative to the semi-submersible transport vessel 1 (step 520). FIG. 7D shows the FPSO vessel 700 in position on the deck 6 and secured (step 530). FIG. 7E shows the FPSO vessel 700 raised on the deck 6 with the normally submerged section 730 above the water level 740 (step 540), while the anchor lines 715 and pipelines 710 are attached to an internal mooring turret 750 of the FPSO vessel 700 and the wellheads 720. FIG. 7F is a top view of the FPSO vessel 700 with the external turret 750. The FPSO vessel 700 overhangs the front 32 of the semi-submersible transport vessel sufficiently to maintain the connection between the pipelines 710 and the internal mooring turret 750, while placing sufficient weight on the deck 6 so that the FPSO vessel 700 may be safely raised by the semi-submersible transport vessel 1.

While the disclosure has been described with reference to exemplary embodiments, it will be understood that various changes may be made and equivalents may be substituted for elements thereof without departing from the scope of the disclosure. In addition, many modifications will be appreciated to adapt a particular instrument, situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

We claim:

1. A method for dry-docking a first vessel connected to a wellhead using a second vessel, the method comprising:

raising a normally submerged section of the first vessel above a water level using the second vessel, while the first vessel is connected to the wellhead wherein the first vessel is disposed at least partially on a deck of the second vessel, wherein the first vessel is a Floating Production Storage and Offloading (FPSO) vessel and the second vessel is a semi-submersible transport vessel.

2. A method for dry-docking a first vessel connected to a wellhead using a second vessel, the method comprising:

raising a normally submerged section of the first vessel above a water level using the second vessel, while the first vessel is connected to the wellhead wherein the first vessel is disposed at least partially on a deck of the second vessel and performing FPSO vessel operations while raised, wherein the FPSO vessel operations are hydrocarbon extractions from a wellhead to the FPSO vessel.

3. A method for dry-docking a first vessel connected to wellhead using a second vessel, the method comprising:

raising a normally submerged section of the first vessel above a water level using the second vessel, while the first vessel is connected to the wellhead wherein the first vessel is disposed at least partially on a deck of the second vessel and performing FPSO vessel operations while raised, wherein the FPSO vessel operations are hydrocarbon processing.

4. A method for dry-docking a first vessel using a second vessel, the method comprising:

performing a dry-dock operation while the first vessel maintains vessel operations, wherein the dry-dock operation involves a normally submerged section of the first vessel that has been raised above a water level using a deck of the second vessel, wherein the vessel operations are hydrocarbon extractions from a wellhead to the first vessel.

5. A method for dry-docking a first vessel using a second vessel, the method comprising:

performing a dry-dock operation while the first vessel maintains vessel operations, wherein the dry-dock operation involves a normally submerged section of the first vessel that has been raised above a water level using a deck of the second vessel, wherein the vessel operations are hydrocarbon processing while the first vessel is connected to a wellhead.

6. A method for dry-docking a first vessel using a second vessel, the method comprising:

performing a dry-dock operation while the first vessel maintains vessel operations, wherein the dry-dock operation involves a normally submerged section of the first vessel that has been raised above a water level using a deck of the second vessel, wherein the first vessel is a floating production, storage, and offloading vessel (FPSO) and the second vessel is a semi-submersible transport vessel, wherein vessel operations are hydrocarbon extractions from a wellhead to the first vessel.

7. A method for dry-docking a vessel using a semi-submersible transport vessel, the method comprising:

submerging a deck of the semi-submersible transport vessel;

moving the vessel and the semi-submersible transport vessel relative to one another such that the deck of the semi-submersible transport vessel is positioned below the vessel;

raising a normally submerged section of the vessel above a water level; and maintaining vessel operations while the normally submerged section of the vessel is above the water level, wherein the vessel operations are hydrocarbons extraction from a wellhead to the vessel.

8. A method for dry-docking a vessel using a semi-submersible transport vessel, the method comprising:

submerging a deck of the semi-submersible transport vessel;

moving the vessel and the semi-submersible transport vessel relative to one another such that the deck of the semi-submersible transport vessel is positioned below the vessel;

raising a normally submerged section of the vessel above a water level; and maintaining vessel operations while the normally submerged section of the vessel is above the water level, wherein the vessel operations are hydrocarbon processing while the vessel is connected to a wellhead.

* * * * *